US010287735B2

(12) United States Patent
Collier, Jr.

(10) Patent No.: US 10,287,735 B2
(45) Date of Patent: May 14, 2019

(54) VEHICLE ARRESTOR SYSTEM

(71) Applicant: Pedro Bento Collier, Jr., The Villages, FL (US)

(72) Inventor: Pedro Bento Collier, Jr., The Villages, FL (US)

( * ) Notice: Subject to any disclaimer, the term of this patent is extended or adjusted under 35 U.S.C. 154(b) by 0 days.

(21) Appl. No.: 16/041,912

(22) Filed: Jul. 23, 2018

(65) Prior Publication Data

US 2019/0063019 A1 Feb. 28, 2019

Related U.S. Application Data

(60) Provisional application No. 62/549,559, filed on Aug. 24, 2017.

(51) Int. Cl.

| | |
|---|---|
| ***E01F 13/00*** | (2006.01) |
| ***E01F 13/04*** | (2006.01) |
| ***E01F 13/12*** | (2006.01) |
| ***E01F 9/529*** | (2016.01) |

(52) U.S. Cl.
CPC ..... *E01F 13/046* (2013.01); *E01F 9/529* (2016.02); *E01F 13/126* (2013.01)

(58) Field of Classification Search
CPC ..... E01F 13/046; E01F 13/126; E01F 9/529
USPC ..... 404/6
See application file for complete search history.

(56) References Cited

U.S. PATENT DOCUMENTS

| | | | | |
|---|---|---|---|---|
| 1,555,386 | A * | 9/1925 | Schillinger | B61L 29/026 246/293 |
| 4,554,695 | A * | 11/1985 | Rowland | F41H 11/08 14/69.5 |
| 4,600,335 | A | 7/1986 | Truglio | |
| 4,647,246 | A | 3/1987 | Brink et al. | |
| 4,923,327 | A | 5/1990 | Gorlov | |
| 5,993,104 | A | 11/1999 | Marcotullio et al. | |
| 7,604,430 | B2 * | 10/2009 | Pervan | F41H 11/08 404/6 |
| 7,775,738 | B2 | 8/2010 | Darcy | |
| 7,828,492 | B2 | 11/2010 | Rogers et al. | |
| 2015/0252540 | A1 * | 9/2015 | Lee | E01F 13/123 404/6 |

* cited by examiner

*Primary Examiner* — Raymond W Addie
(74) *Attorney, Agent, or Firm* — Peter J. Rashid

(57) ABSTRACT

A vehicle arrestor system includes a ditch box defined by a pair of opposing side walls and a bottom wall extending between the side walls forming a chamber therebetween. A movable plate forms at least a portion of a top wall of the chamber. A mechanical actuator is operably coupled to the movable plate for causing the movable plate to move between a non-actuated position and an actuated position. The movable plate is flush with the road pavement when in the non-actuated position and is not flush with the road pavement when in the actuated position. The vehicle arrestor system serves a dual purpose of arresting movement of a vehicle and providing a notification to a driver of the vehicle to slow down if the vehicle is exceeding the posted speed limit. A plurality of vehicle arrestor systems can be strategically placed in a "locked island" arrangement.

20 Claims, 7 Drawing Sheets

VEHICLE ARRESTOR SYSTEM

CLAIM TO PRIORITY

This application claims the benefit of U.S. Provisional Application No. 62/549,559, filed on Aug. 24, 2017, the entire contents of which are incorporated herein by reference.

FIELD OF THE INVENTION

The invention relates to a vehicle arrestor system that protects at-risk sites from vehicle born attacks. The present invention is intended for two main purposes: 1) a vehicle speed limit enforcement system (i.e., speed reduction); and 2) a vehicle arrestor system that can be effective in certain type of terrorist attack.

BACKGROUND OF THE INVENTION

Barriers for restricting the passage of vehicles (such as automobiles, trucks, busses, airplanes and the like) are generally known. Barriers that are fixed in the roadway, meaning they do not move by device or mechanism, are typically categorized as "passive" or "inoperable" barriers. These types of barriers are either removably placed on the roadway or sidewalk surrounding an at-risk site, or they are installed into the ground or built into the landscape/streetscape. Known installed "passive" barriers typically include foundation walls (typically at least 36" high), or bollards in the form of "posts" embedded in a concrete foundation, and beds of a crushable material (such as concrete). Walls and bollards are intended to stop vehicles through impact resistance, having sufficient shear strength to remain intact at impact and relying on the inertia of their foundations to bring a vehicle to a halt.

In addition to vehicle barrier systems, vehicle arresting systems are also known. Where vehicle barrier systems are intended to immediately stop a vehicle, vehicle arresting systems are intended to control the stopping of a vehicle over a given time and/or distance. Known arresting systems include beds of a crushable material (such as concrete), fences and gates, and cable and elastic (e.g. "bungee cord") systems. Crushable beds tend to utilize the interaction between the bed and the tire(s) of the vehicle. As a vehicle moves across the crushable material, the weight of the vehicle causes it to sink into the bed. At the same time, the spinning of the tire "rips" through the crushable material. As the vehicle drops farther into the bed, the tires' rotation tends to become slower until finally the vehicle is stopped. For example, crushable beds at the ends of aircraft runways for aircraft that "overshoot" the runway are generally known for gradually decelerating the aircraft over an extended distance to minimize injury to occupants and damage to the aircraft.

These known vehicle barriers present a number of functional problems. Walls significantly impede pedestrian traffic and can cause pedestrian "herding" and "bottle necking." Additionally, walls, and bollards as well, are somewhat visually restricting. The inherent height of the two, that is necessary for their function as a vehicle barrier, reduces the visual "openness" of the landscape/streetscape. Crushable beds are not optimal because they typically require an extended length of the crushable bed (upwards of 50 feet or more) to arrest a vehicle (and substantially longer for aircraft and the like). Such long lengths are generally not compatible with most urban applications, where space between a roadway and a building line or perimeter line is fairly small (e.g. 5-30 feet) and a primary objective of the barrier is to stop the progress of the vehicle within a relatively short distance. Such known vehicle barrier systems tend to provide limited application and flexibility to designers in providing an effective vehicle barrier system intended to meet applicable government performance standards, and is minimally obtrusive, for use in areas such as urban settings that typically have limited space for installation of such barriers.

In view of the foregoing, it would be highly desirable to provide an improved vehicle arrestor system that can serve a dual purpose of limiting vehicle speed and arresting movement of the vehicle.

SUMMARY OF THE INVENTION

The problem associated with providing a vehicle arrestor system that can serve a dual purpose is solved by providing a vehicle arrestor system that can be placed in an actuated position in which a movable plate is lower in elevation by a distance, D1, that will arrest forward movement of a vehicle, and can be lower in elevation by a distance, D2, than is smaller than the distance, D1, that notifies the driver to slow down.

In accordance with an aspect of the invention, a vehicle arrestor system comprises a ditch box defined by a pair of opposing side walls and a bottom wall extending between the side walls forming a chamber therebetween; a movable plate forming at least a portion of a top wall of the chamber; and a mechanical actuator operably coupled to the movable plate for causing the movable plate to move between a non-actuated position and an actuated position. The movable plate is substantially flush with a top surface of road pavement when in the non-actuated position, and the movable plate is not substantially flush with the top surface of road pavement when in the actuated position.

In another aspect, a vehicle arrestor system comprises a ditch box defined by a pair of opposing side walls and a bottom wall extending between the side walls forming a chamber therebetween; a movable plate forming at least a portion of a top wall of the chamber; and a mechanical actuator operably coupled to the movable plate for causing the movable plate to move between a non-actuated position and an actuated position. The vehicle arrestor system serves a dual purpose of arresting movement of a vehicle and providing a notification to a driver of the vehicle to slow down if the vehicle is exceeding the posted speed limit.

In yet another aspect of the invention, a method of controlling a vehicle leaving and entering a desired area by positioning one or more vehicle arrestor systems of the invention in strategically placed locations, P1-P3 in a "locked island" arrangement.

These and other aspects of the present invention will be more fully understood following a review of this specification and drawings.

BRIEF DESCRIPTION OF THE DRAWINGS

While various embodiments of the invention are illustrated, the embodiments shown should not be construed to limit the claims. It is anticipated that various changes and modifications may be made without departing from the scope of this invention.

DETAILED DESCRIPTION OF THE INVENTION

Figure 1:
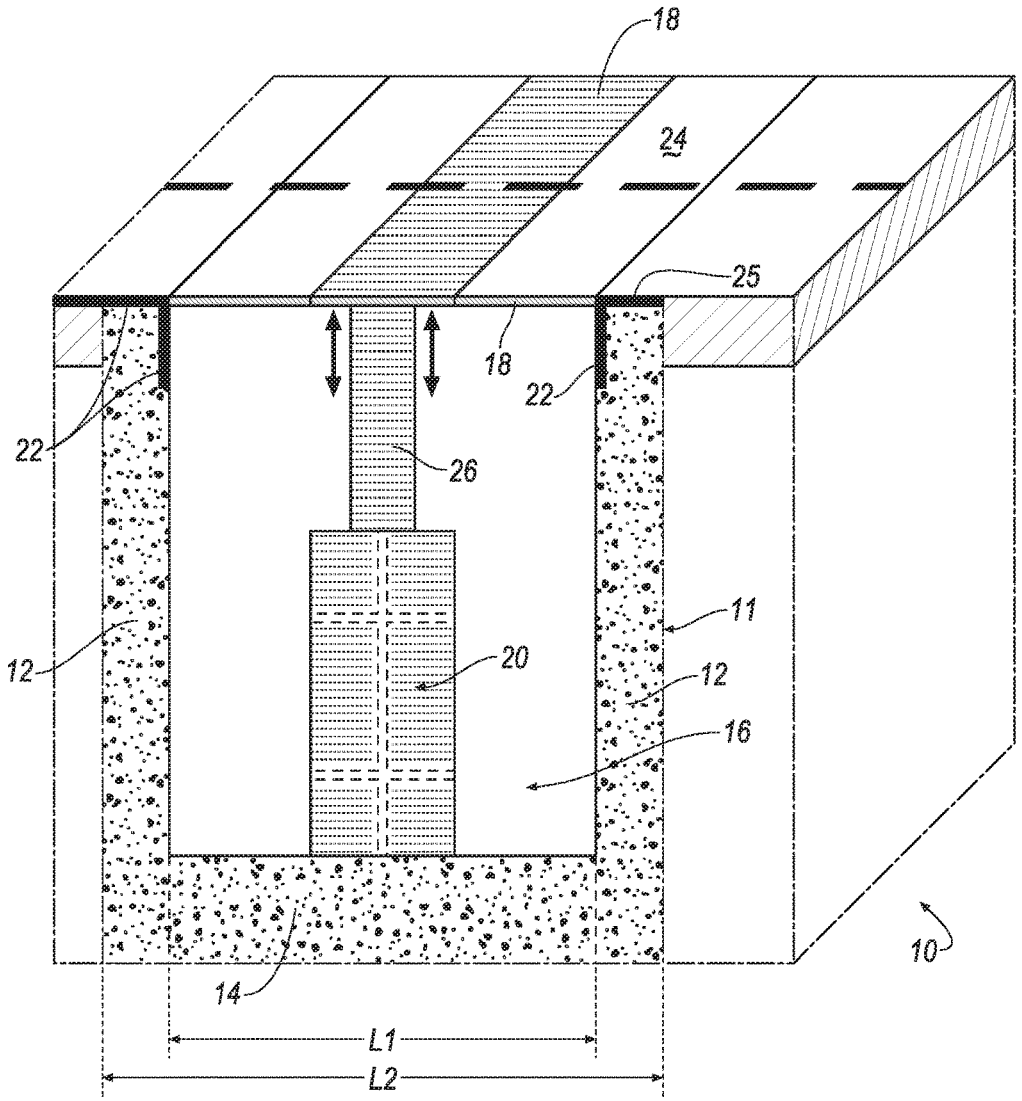
FIG. 1 is a schematic representation of a perspective view of the vehicle arrestor system when in a non-actuated position according to an embodiment of the invention.
Figure 2:
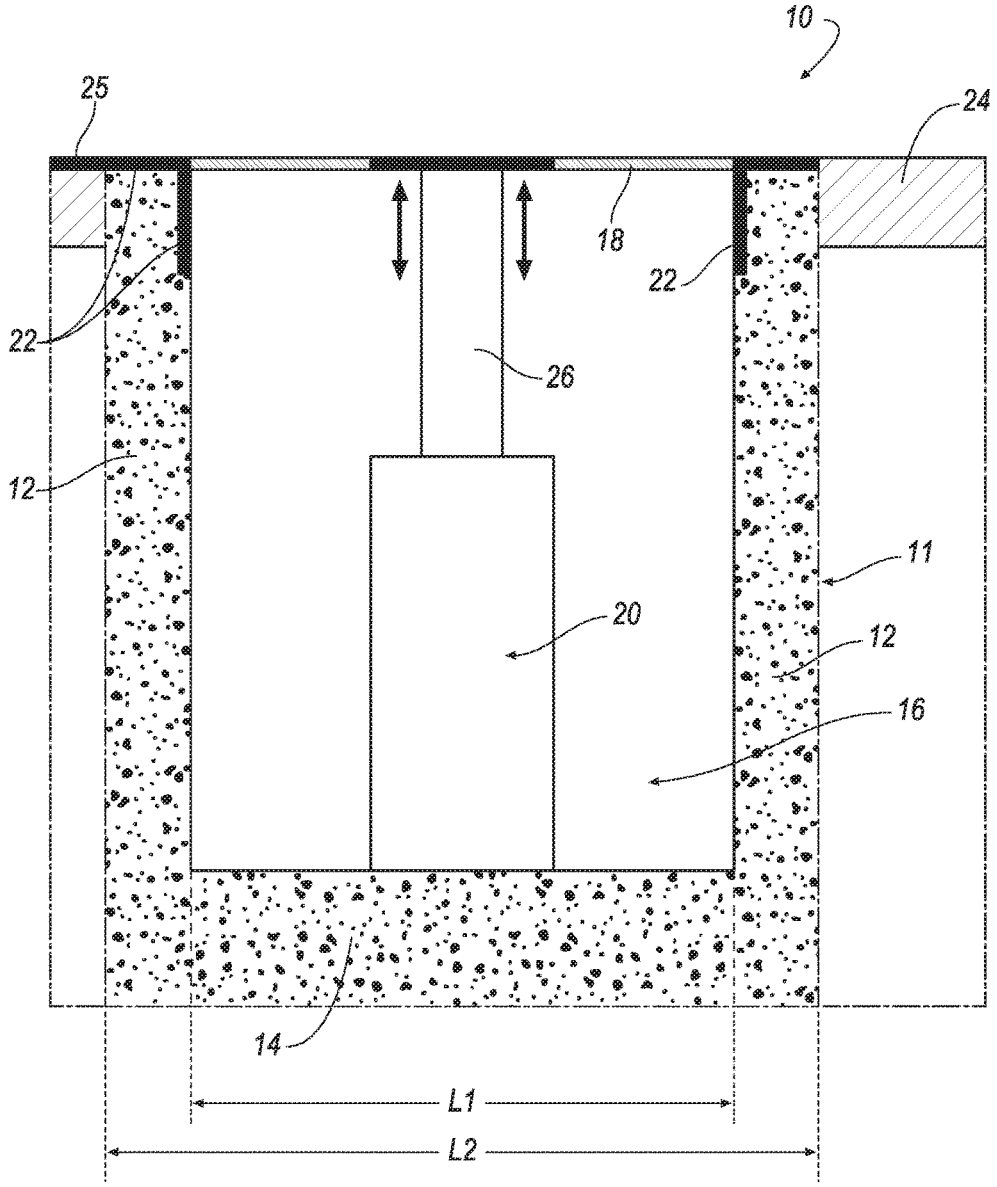
FIG. 2 is a schematic representation of a lateral view the vehicle arrestor system of FIG. 1 when in the non-actuated position.

Referring to the drawings, FIGS. 1 and 2 show a vehicle arrestor system, generally designated as 10, according to an embodiment of the invention. In general, the vehicle arrestor system 10 comprises a ditch box 11 made of reinforced cement concrete (RCC) 12 having a pair of opposing side walls 12 and a bottom wall 14 extending between the pair of opposing side walls 12 forming a chamber 16 therebetween. The chamber 16 has an internal width, L1, and an external width, L2. Thus, the side walls 12 have a width or thickness equal to L2–L1. The vehicle arrestor system 10 also comprises a movable plate 18 forming at least a portion of a top wall of the chamber 16, and a mechanical actuator 20 for moving the plate 18 between a non-actuated position and an actuated position. The movable plate 18 can be made of steel, reinforced cement concrete, or any other suitable material. The vehicle arrestor system 10 may also comprise a frame 22 for providing reinforcement the side walls 12 proximate the movable plate 18.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Throughout the text and the claims, use of the word "about" in relation to a range of values (e.g., "about 22 to 35 wt %") is intended to modify both the high and low values recited, and reflects the penumbra of variation associated with measurement, significant figures, and interchangeability, all as understood by a person having ordinary skill in the art to which this invention pertains.

For purposes of this specification (other than in the operating examples), unless otherwise indicated, all numbers expressing quantities and ranges of ingredients, process conditions, etc are to be understood as modified in all instances by the term "about". Accordingly, unless indicated to the contrary, the numerical parameters set forth in this specification and attached claims are approximations that can vary depending upon the desired results sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Further, as used in this specification and the appended claims, the singular forms "a", "an" and "the" are intended to include plural referents, unless expressly and unequivocally limited to one referent.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements including that found in the measuring instrument. Also, it should be understood that any numerical range recited herein is intended to include all sub-ranges subsumed therein. For example, a range of "1 to 10" is intended to include all sub-ranges between and including the recited minimum value of 1 and the recited maximum value of 10, i.e., a range having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

As shown in FIGS. 1 and 2, the vehicle arrestor system 10 is in the non-actuated position. In the non-actuated position, the movable plate 18 is substantially flush with a top surface 25 of the road pavement 24.

In one embodiment, mechanical actuator 20 for moving the movable plate 18 comprises a conventional hydraulic cylinder (also called a linear hydraulic motor) with a piston rod 26 operably coupled to the movable plate 18 for providing a unidirectional force though a unidirectional stroke. The hydraulic cylinder 20 moves the movable plate 18 upwards and downwards in the vertical direction (indicated by the arrows in FIG. 1). The hydraulic cylinder is powered from pressurized hydraulic fluid, such as oil, air, steam, and the like, from a source of pressurized hydraulic fluid (not shown) of a type well-known in the art. However, it will be appreciated that the invention is not limited by the type of means to move the movable plate 18, and that the invention can be practiced with any suitable means for moving the plate 18, such a pneumatic cylinder, a telescopic cylinder, a plunger cylinder, a differential cylinder, a position sensing "smart" hydraulic cylinder, and the like.

Figure 3:
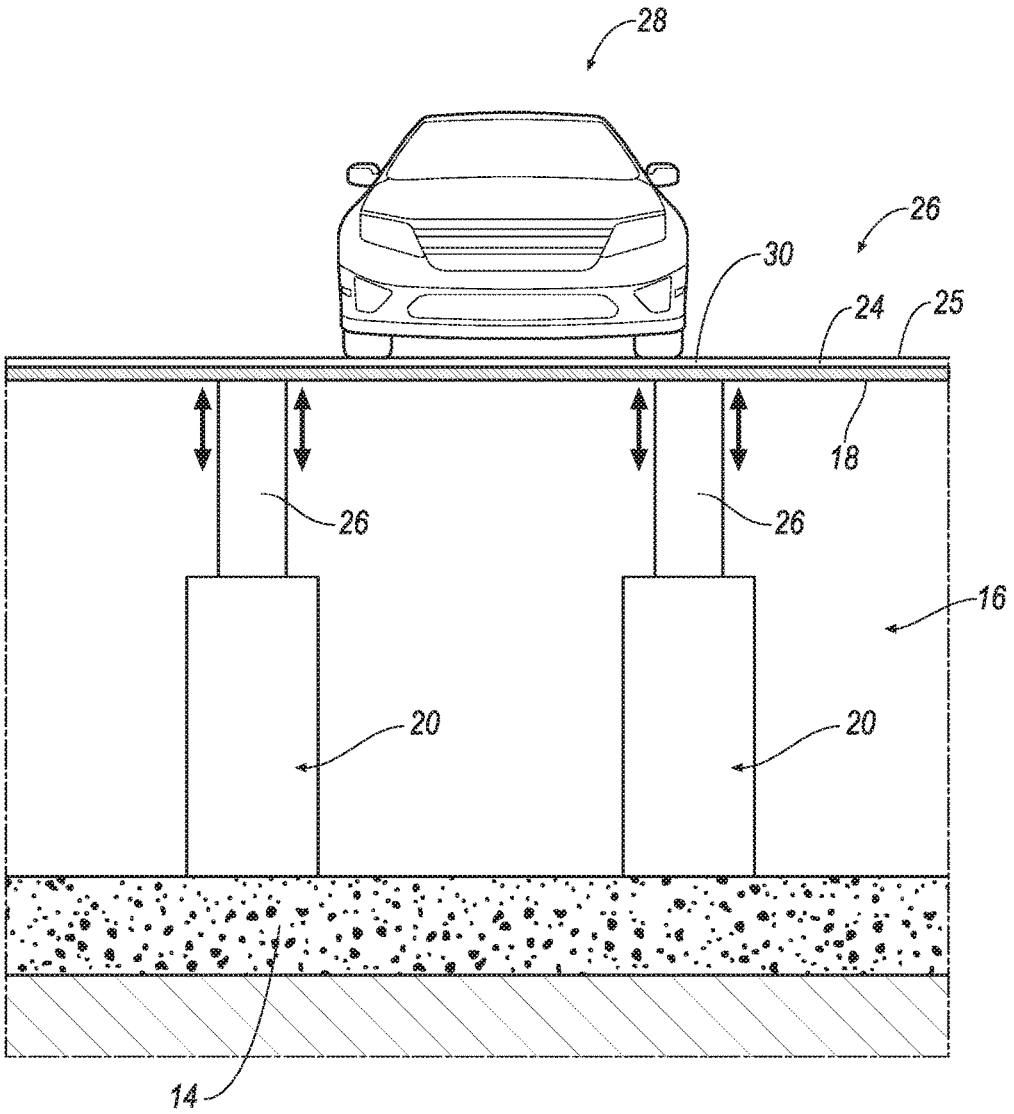
FIG. 3 shows a schematic representation of a longitudinal view of the vehicle arrestor system on a segment of one lane of a street when in a non-actuated position.

FIG. 3 shows a schematic representation of a longitudinal view of the vehicle arrestor system 10 on a segment of one lane of a street 26 when in a non-actuated position, i.e., the movable plate 18 is substantially flush with the road pavement 24. When in the non-actuated position, a vehicle 28 can drive over the vehicle arrestor system 10 in a normal (i.e., a non-obstructed) manner. It should be noted that, in this embodiment, the movable plate 18 has a layer of material 30 that is similar to the material of the road pavement 24, such as reinforced cement concrete (RCC), and the like. However, the movable plate 18 can be made of a different material than the road pavement 24. For example, the movable plate 18 may comprise an anti-skidding, corrugated steel plate, or a combination of the same material as the road pavement 24 and a different material, such as steel, and the like. By being substantially flush with the top surface 25 of the road pavement 24, the movable plate 18 cannot be easily detected by a driver (not shown) of the vehicle 28. In the illustrated embodiment, the vehicle arrestor system 10 comprises a pair of mechanical actuators 20. However, it should be appreciated that the invention is not limited by the number of mechanical actuators 20, and that the invention can be practiced with any desirable number of mechanical actuators 20 to provide adequate upwards and downwards force on the movable plate 18.

Figure 4:
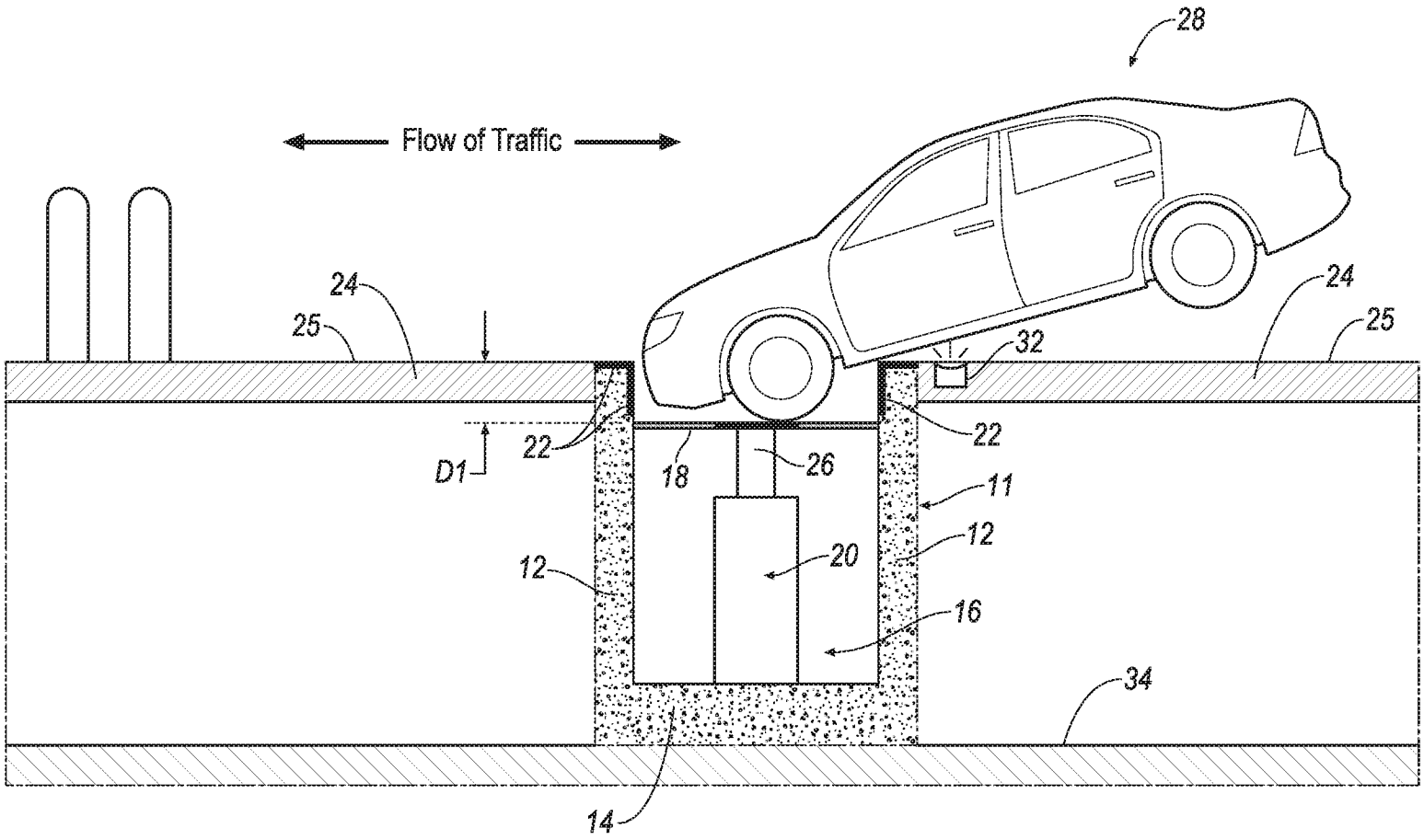
FIG. 4 shows a schematic representation of a longitudinal view of the vehicle arrestor system when in an actuated position to prevent any further movement of the vehicle.

FIG. 4 shows a schematic representation of a longitudinal view of the vehicle arrestor system 10 when in an actuated position. As can be seen, the entire movable plate 18 is at a lower elevation than when the vehicle arrestor system 10 is in a non-actuated position, unlike conventional vehicle arrestor systems that pivot about a pivot point at one end of the system when actuated. In addition, the entire movable plate 18 is substantially parallel to the top surface 25 of the road pavement 24 when the vehicle arrestor system 10 is in the actuated position.

When in the actuated position, the movable plate 18 is lower in elevation by a distance, D1, as compared to the non-actuated position in which the movable plate 18 is substantially flush with the top surface 25 of the road pavement 24. Of course, the movable plate 18 can at a higher elevation than the top surface 25 of the road pavement 24, but more damage may occur to the movable plate 18. It should be appreciated that the distance, D1, should be sufficient in order to arrest forward movement of the vehicle 28. In one embodiment, the distance, D1, is a function of the tire diameter of the vehicle 28. For example, the distance, D1, can be at least one-half the tire diameter of the vehicle 28. Thus, the distance, D1, can be at least 7 inches.

The vehicle arrestor system 10 may also include a warning light 32 that provides the driver (not shown) of the vehicle 28 with a visual indication that the vehicle arrestor system 10 has been activated and in the actuated position. It should be appreciated that the forward progress of the vehicle 28 is completely stopped when the vehicle arrestor system 10 is in the actuated position, as shown in FIG. 4. In the illustrated embodiment, the movable plate 18 of the vehicle arrestor system 10 is disposed substantially perpendicular to the flow of traffic. In this arrangement, the vehicle arrestor system 10 targets one vehicle at a time. However, it will be appreciated that the movable plate 18 can be disposed substantially parallel to the flow of traffic to target more than one vehicle at a time, if desired. In addition, the vehicle arrestor system 10 may also include a base layer 34 made of a suitable material for providing a sufficient foundation for the bottom wall 14 of the ditch box 11.

As shown in FIG. 4, the vehicle arrestor system 10 is in the actuated position to arrest forward movement of the vehicle 28. However, the vehicle arrestor system 10 can serve a dual purpose and notify the drive of the vehicle 28 to slow down, rather than arresting movement of the vehicle 28. It should be noted that the vehicle arrestor system 10 is capable of arresting forward and/or backward movement of the vehicle 28.

Figure 5:
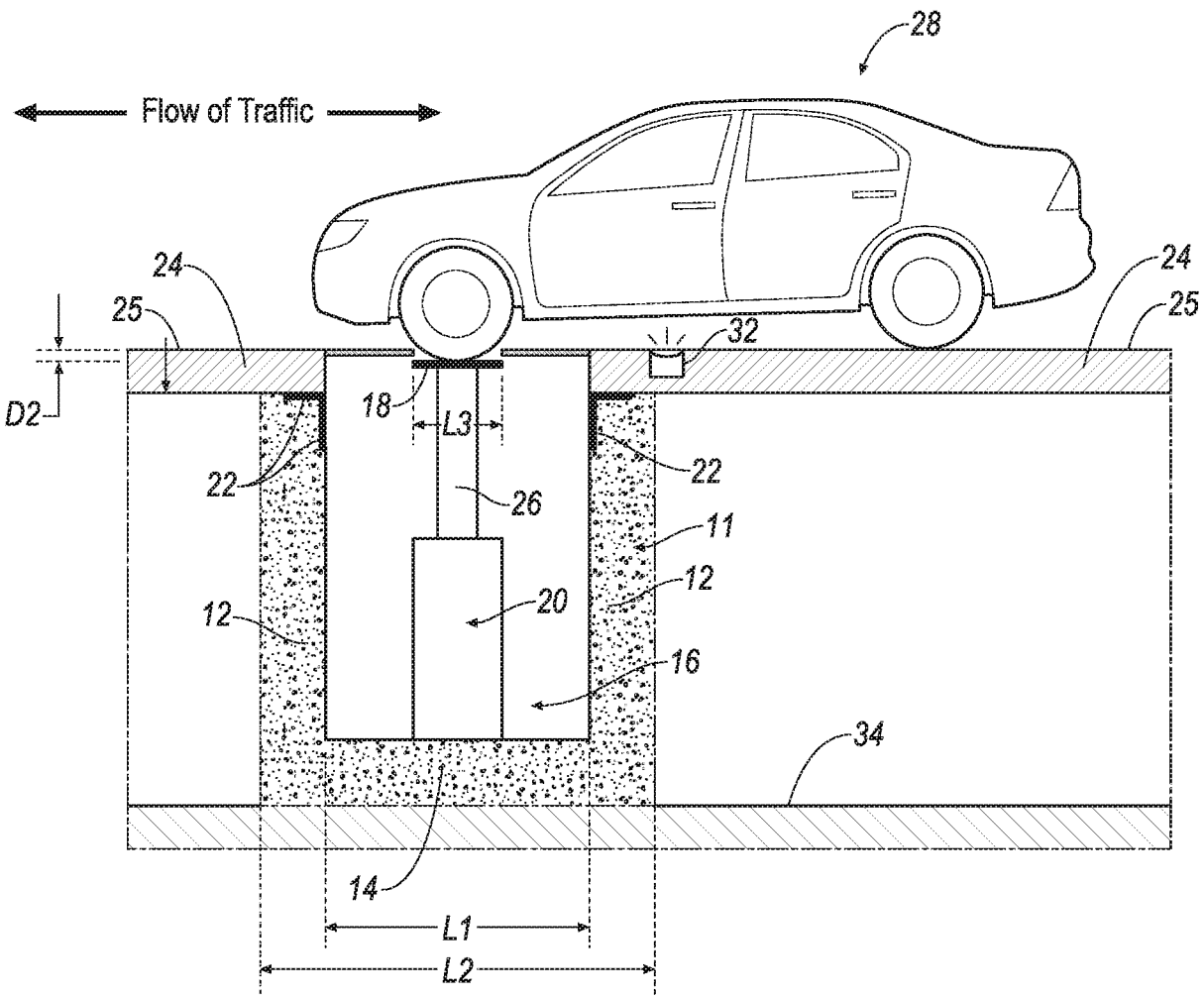
FIG. 5 shows a schematic representation of a longitudinal view of the vehicle arrestor system when in an actuated position to provide a notification to the driver of the vehicle to slow down.

Referring now to FIG. 5, the vehicle arrestor system 10 is in the actuated position to provide a notification the driver of the vehicle 28 to slow down. This is achieved by moving at least a portion of the movable plate 18 a distance, D2, lower in elevation than the top surface 25 of the road pavement 24. The distance, D2, is smaller than the distance, D1, and in a range between about 1-5 inches. It should be noted that in any of the actuated positions shown in FIG. 4, the entire movable plate 18 is lower in elevation than the top surface 25 of the road pavement 24. However, in FIG. 5, the portion of the movable plate 18 that is lower in elevation that the top surface 25 of the road pavement 24 has a width, L3, which is less than the internal width, L1, of the chamber 16. Thus, in FIG. 5, only a portion of the movable plate 18 is lower in elevation than the top surface 25 of the road pavement 24. However, it should be appreciated that the entire movable plate 18 in FIG. 5 can be lower in elevation than the top surface 25 of the road payment 24, similar to the embodiment shown in FIG. 4.

Figure 6:
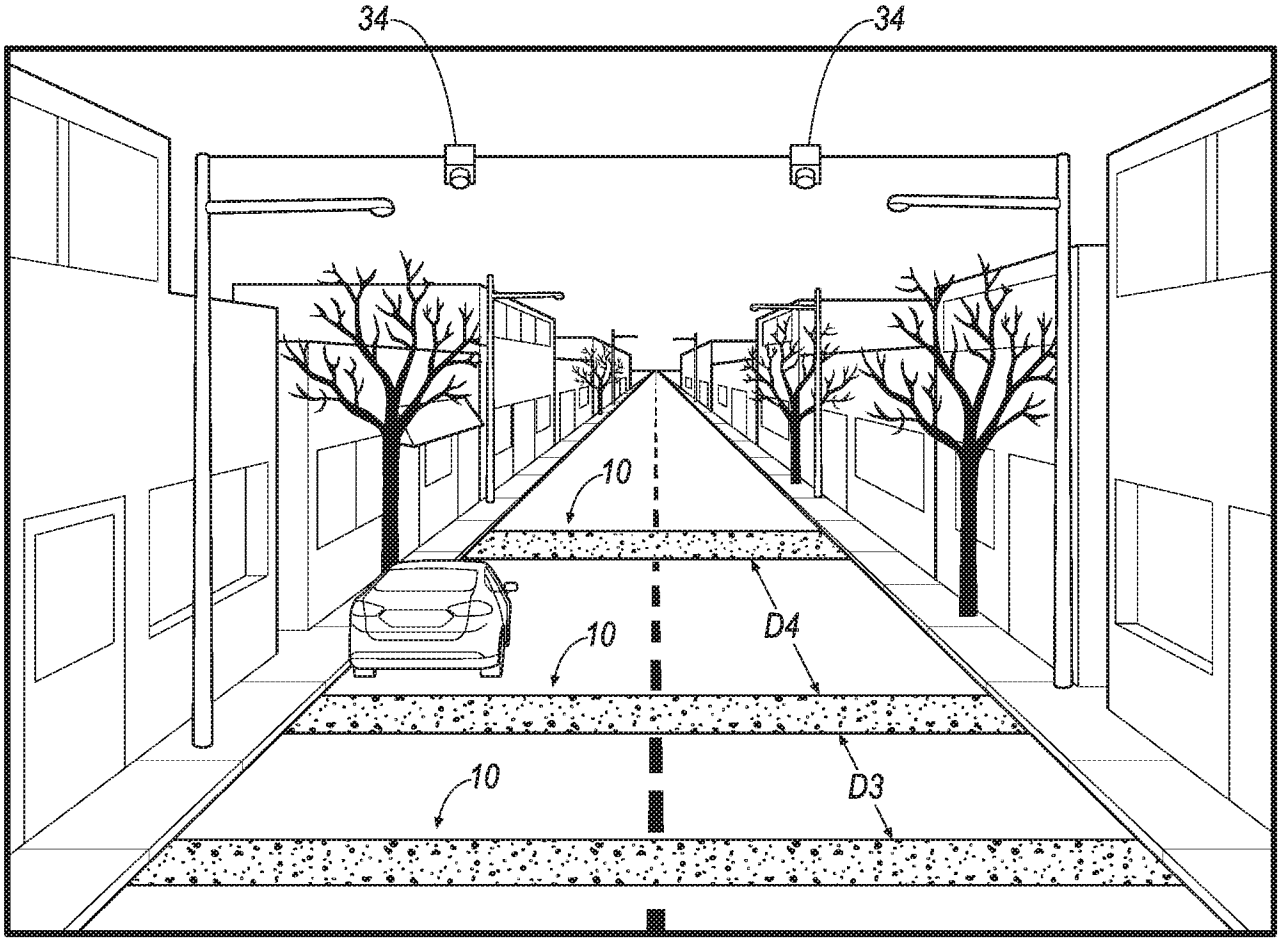
FIG. 6 shows a schematic representation of a perspective view of a street with a plurality of vehicle arrestor systems of the invention that can be activated when the vehicle exceeds the posted speed limit.

FIG. 6 shows a schematic representation of a perspective view of a street with a plurality of vehicle arrestor systems 10 of the invention that can be activated when the vehicle 28 exceeds the posted speed limit. One way of activating the vehicle arrestor systems 10 is with one or more cameras 34 that can detect whether the driver of the vehicle 28 is exceeding the posted speed limit. The plurality of vehicle arrestor systems 10 form sequence layers of speed control and monitoring of the vehicle 28. For example, the first vehicle arrestor system 10 can be separated from the second vehicle arrestor system 10 by a predetermined distance, D3, and the second vehicle arrestor system 10 can be separated from the third vehicle arrestor system 10 by a predetermined distance, D4. The distances, D3 and D4, can be equal to each other, or can be different from each other.

In addition, the movable plate 18 of one or more of the vehicle arrestor systems 10 can be at the same elevation beneath the top surface 25 of the road pavement 24 or can be at different elevations. For example, the movable plate 18 of the vehicle arrestor system 10 that the driver first encounters may only be at an elevation of 1 inch below the top surface 25 of the road pavement 24. If the driver does not slow down below the posted speed limit, the movable plate 18 of the previously encountered vehicle arrestor system 10 encountered by the driver may be at an elevation of 2-4 inches below the top surface 25 of the road pavement 24. That is, the movable plate 18 of the next vehicle arrestor system 10 encountered by the driver will be at a lower elevation than the movable plate 18 of the first vehicle arrestor system 10. If the driver continues not to slow down below the posted speed limit, the movable plate 18 of the next vehicle arrestor system 10 encountered by the driver may be at an elevation of 5-7 inches below the top surface 25 of the road pavement 24. That is, the movable plate 18 of the next vehicle arrestor system 10 encountered by the driver will be at a lower elevation than the movable plate 18 of the previously encountered vehicle arrestor system 10. As can be understood, the movable plate 18 of each vehicle arrestor system 10 can be at any suitable elevation with respect to the top surface 25 of the road pavement 24 to produce the desired warning to the driver of the vehicle.

Figure 7:
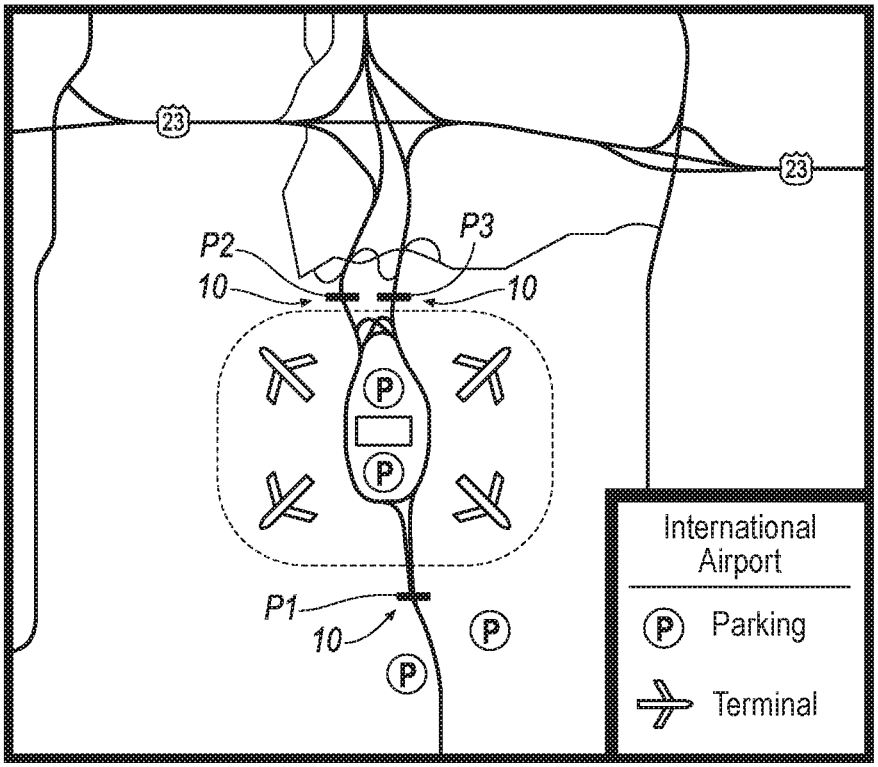
FIG. 7 shows a plan view of the Orlando International Airport showing the concept of a "locked island" to prevent any vehicles from entering and/or leaving the airport.

The vehicle arrestor system 10 can be arranged in a variety of different configurations. One such arrangement is shown in FIG. 7. FIG. 7 shows a plan view of the Orlando International Airport showing the arrangement of a plurality of vehicle arrestors systems 10 in a "locked island" arrangement for controlling which vehicles, if any, that can enter and/or leave Orlando International Airport. In the illustrated "locked island" arrangement, one or more vehicle arrestor systems 10 are positioned at strategic locations, P1-P3, to enable an entity, such as law enforcement, to control which vehicles enter and/or leave the airport. The "locked island" arrangement may be used for any scenario in which control of vehicles entering and/or leaving an area is desired. For example, the "locked island" arrangement can be used during a terrorist attack, and the like.

As described above, the vehicle arrestor system 10 serves a dual purpose of arresting movement (i.e., forward and/or backward movement) of the vehicle 28 and providing a notification to the driver of the vehicle 28 to slow down if the vehicle 28 is exceeding the posted speed limit. It should be appreciated that the invention can be used for solely arresting movement of vehicle 28 or can be used for solely providing a notification to the driver of the vehicle 28 to reduce speed. In addition, one or more vehicle arrestor systems 10 of the invention can be positioned at strategically placed in the "locked island" arrangement The patents and publications referred to herein are hereby incorporated by reference.

Whereas particular aspects of this invention have been described above for purposes of illustration, it will be evident to those skilled in the art that numerous variations of the details of the present invention may be made without departing from the invention as defined in the appended claims.

What is claimed is:

1. A vehicle arrestor system, comprising:

a ditch box defined by a pair of opposing side walls and a bottom wall extending between the side walls forming a chamber therebetween;

a movable plate forming at least a portion of a top wall of the chamber; and a mechanical actuator operably coupled to the movable plate for causing the movable plate to move between a non-actuated position and an actuated position, wherein the movable plate is substantially flush with a top surface of road pavement when in the non-actuated position, wherein the movable plate is not substantially flush with the top surface of road pavement when in the actuated position; and wherein the movable plate is substantially parallel along its length to the top surface of the road pavement when the vehicle arrestor system is in the actuated position.

2. The vehicle arrestor system according to claim 1, wherein the movable plate is lower in elevation than the road pavement when in the actuated position.

3. The vehicle arrestor system according to claim 1, wherein the movable plate is disposed substantially perpendicular to a flow of traffic.

4. The vehicle arrestor system according to claim 1, wherein the movable plate travels a distance, D1, that is at least 7 inches.

5. The vehicle arrestor system according to claim 1, wherein the movable plate has a layer of material that is similar to a material of the road pavement.

6. The vehicle arrestor system according to claim 1, wherein the vehicle arrestor system serves a dual purpose of arresting movement of a vehicle and providing a notification to a driver of the vehicle to slow down if the vehicle is exceeding the posted speed limit.

7. The vehicle arrestor system according to claim 1, wherein a plurality of vehicle arrestor systems are positioned at strategic locations to control which vehicles enter or leave a desired area.

8. The vehicle arrestor system according to claim 1, wherein the movable plate extends entirely across the top wall of the chamber.

9. The vehicle arrestor system according to claim 1, further comprising a plurality of vehicle arrestor systems separated by a predetermined distance from each other for speed control and monitoring of a vehicle.

10. The vehicle arrestor system according to claim 9, wherein a movable plate of a first vehicle arrestor system encountered by the vehicle has a first elevation below the top surface of road pavement, and wherein a movable plate of a second vehicle arrestor system encountered by the vehicle has a second elevation below the top surface of the road pavement, and wherein the second elevation is greater than the first elevation.

11. The vehicle arrestor system according to claim 1, wherein the vehicle arrestor system provides a notification to a driver of a vehicle to slow down.

12. The vehicle arrestor system according to claim 11, further comprising one or more cameras that can detect whether the driver of the vehicle is exceeding the posted speed limit.

13. A vehicle arrestor system, comprising:

a ditch box defined by a pair of opposing side walls and a bottom wall extending between the side walls forming a chamber therebetween;

a non-pivoting, movable plate forming at least a portion of a top wall of the chamber; and a mechanical actuator operably coupled to the movable plate for causing the movable plate to move between a non-actuated position and an actuated position, wherein the vehicle arrestor system serves a dual purpose of arresting movement of a vehicle and providing a notification to a driver of the vehicle to slow down if the vehicle is exceeding the posted speed limit.

14. The vehicle arrestor system according to claim 13, wherein the movable plate is substantially flush with a top surface of road pavement when in a non-actuated position, and wherein the movable plate is not substantially flush with the top surface of road pavement when in an actuated position.

15. The vehicle arrestor system according to claim 14, wherein the movable plate travels a first distance, D1, when in the actuated position to arrest forward movement of the vehicle, and wherein the movable plate travels a second distance, D2, when in the actuated position to provide notification to the driver of the vehicle to slow down, and wherein D2 is less than D1.

16. The vehicle arrestor system according to claim 14, wherein the movable plate is lower in elevation than the road pavement when in the actuated position.

17. The vehicle arrestor system according to claim 14, wherein the movable plate is substantially parallel to the top surface of the road pavement when the vehicle arrestor system is in the actuated position.

18. The vehicle arrestor system according to claim 14, wherein the movable plate has a layer of material that is similar to a material of the road pavement.

19. The vehicle arrestor system according to claim 14, wherein the movable plate travels a distance, D1, that is at least 7 inches.

20. A method of controlling a vehicle from leaving and/or entering a desired area by positioning a plurality of vehicle arrestor systems in strategically placed locations, P1-P3, in a "locked island" arrangement, each vehicle arrestor system comprising:

a ditch box defined by a pair of opposing side walls and a bottom wall extending between the side walls forming a chamber therebetween;

a non-pivoting, movable plate forming at least a portion of a top wall of the chamber, wherein the movable plate is substantially flush with a top surface of road pavement when in a non-actuated position, and wherein the movable plate is not substantially flush with the top surface of road pavement when in an actuated position; and a mechanical actuator operably coupled to the movable plate for causing the movable plate to move between the non-actuated position and the actuated position.

* * * * *